US009082567B2

(12) United States Patent
Chen et al.

(10) Patent No.: US 9,082,567 B2
(45) Date of Patent: Jul. 14, 2015

(54) METHOD AND APPARATUS PERTAINING TO KEYPAD FRETS

(71) Applicant: Research In Motion Limited, Waterloo (CA)

(72) Inventors: Chao Chen, Waterloo (CA); Xiaofeng Li, Kitchener (CA); Li Huang, Kitchener (CA)

(73) Assignee: BlackBerry Limited, Waterloo, Ontario (CA)

( * ) Notice: Subject to any disclaimer, the term of this patent is extended or adjusted under 35 U.S.C. 154(b) by 209 days.

(21) Appl. No.: 13/673,245

(22) Filed: Nov. 9, 2012

(65) Prior Publication Data

US 2014/0131181 A1 May 15, 2014

(51) Int. Cl.
*H01H 13/70* (2006.01)
*H01H 13/88* (2006.01)

(52) U.S. Cl.
CPC ..... *H01H 13/88* (2013.01); *H01H 2223/008* (2013.01); *H01H 2229/02* (2013.01); *Y10T 29/49105* (2015.01)

(58) Field of Classification Search
CPC ..... H01H 13/70
USPC ..... 200/345, 314, 341, 310, 311, 5 A
See application file for complete search history.

(56) References Cited

U.S. PATENT DOCUMENTS

| | | | | |
|---|---|---|---|---|
| 6,864,881 | B2 * | 3/2005 | Lee | 345/168 |
| 7,671,290 | B2 * | 3/2010 | Chen et al. | 200/314 |
| 7,928,963 | B2 * | 4/2011 | Chang et al. | 345/169 |
| 8,698,018 | B2 * | 4/2014 | Lamers et al. | 200/5 A |
| 2001/0003539 | A1 | 6/2001 | Hahm et al. | |
| 2008/0018606 | A1 * | 1/2008 | Chen | 345/169 |
| 2009/0107816 | A1 * | 4/2009 | Chen et al. | 200/314 |
| 2011/0018161 | A1 * | 1/2011 | Yang | 264/153 |
| 2011/0073456 | A1 | 3/2011 | Chen | |

FOREIGN PATENT DOCUMENTS

EP 0585536 A1 3/1994

OTHER PUBLICATIONS

Nieto, José Miguel; Examiner; Extended European Search Report from related European Patent Application No. 12191943.5 dated Apr. 5, 2013; 5 pages.

* cited by examiner

*Primary Examiner* — Renee Luebke
*Assistant Examiner* — Ahmed Saeed
(74) *Attorney, Agent, or Firm* — Fleit Gibbons Gutman Bongini & Bianco P.L.

(57) ABSTRACT

A keypad comprises a keypad frame and a metal spacer disposed on a backside thereof. At least one metal fret having a plurality of metal standoffs is disposed amongst the corresponding keycaps. These metal standoffs connect to the metal spacer (for example, via laser welding). The keypad frame can include a plurality of registration components and the metal spacer can include corresponding registration component-receiving openings disposed therein.

15 Claims, 3 Drawing Sheets

METHOD AND APPARATUS PERTAINING TO KEYPAD FRETS

FIELD OF TECHNOLOGY

The present disclosure relates to keypads and more particularly to keypad frets.

BACKGROUND

Keypads of various kinds are an increasingly ubiquitous necessity. While virtual keypads have increased in number, the importance of physical keypads as an available or even a preferred user-interface modality continues unabated as well.

Physical keypads come in a wide variety of sizes, ranging from full-sized typewriter-styled keyboards to small QWERTY keyboards found on some so-called smartphones. Small keyboards can present numerous design challenges including helping to intrinsically assure that only desired keys are actuated without also inadvertently actuating adjacent keys. Frets are sometimes employed to space rows and/or columns of keys apart from one another in a visually aesthetically-pleasing manner.

Frets are often metallic in appearance but in fact typically comprise plastic having a metallic-looking coating disposed thereon. Plastic materials are well suited to available manufacturing techniques. That said, plastic materials (and their metallic-looking coatings) may not adequately address all application setting needs.

DETAILED DESCRIPTION

Figure 1:
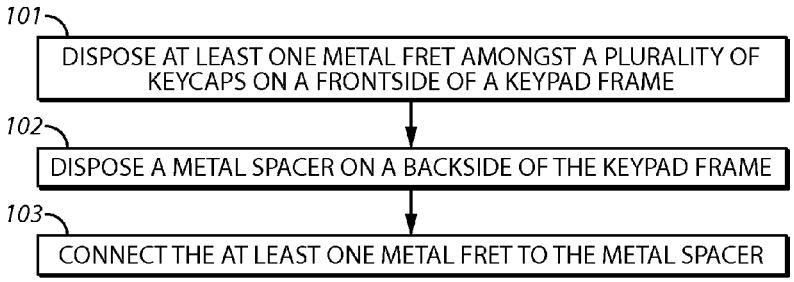
FIG. 1 is a flow diagram in accordance with the disclosure.

The following describes an apparatus and method pertaining to a keypad frame and a metal spacer that is disposed on a backside of that keypad frame. At least one metal fret is disposed amongst keycaps on a frontside of the keypad frame, which metal fret is connected to the metal spacer (for example, via laser welding).

By one approach a plurality of metal frets are disposed amongst the keycaps (to provide, for example, a definitive visual spacer between rows of keycaps). These metal frets may, or may not, be disposed substantially parallel to one another.

By one approach the keypad frame includes a plurality of registration components and the metal spacer, in turn, includes corresponding registration component-receiving openings disposed therein. So configured the metal spacer can be easily and accurately positioned with respect to the keypad frame to facilitate, for example, securing the metal fret(s) to the metal spacer notwithstanding the intervening keypad frame.

By one approach the metal fret includes a plurality of metal standoffs. At least some of these metal standoffs contact the metal spacer and in fact are connected thereto (for example, via laser welding). These teachings will also accommodate providing the metal fret with at least one registration component that is configured to conformably register with a registration component-receiving opening in the keypad frame.

So configured, metal frets can be conveniently and assuredly utilized in a keypad of choice in a manner that is friendly to typical and available manufacturing capabilities and that contributes to the ease and quality of manufacturing rather than detracting from such considerations. In addition, the applicants have determined that metal frets not only provide a superior visual aesthetic but also offer superior wear and usage characteristics in many application settings.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

Figure 2:
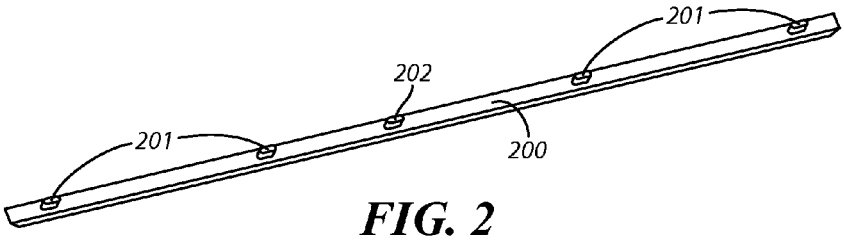
FIG. 2 is a perspective view in accordance with the disclosure.

FIG. 1 presents a process 100 that includes, at 101, disposing at least one metal fret amongst a plurality of keycaps on a frontside of a keypad frame. FIG. 2 presents an illustrative example of such a metal fret 200. In this example the metal fret 200 comprises an elongated essentially-linear member having an upper surface that presents a somewhat rounded cross section.

The underside of the metal fret 200 in this example is essentially planar and includes a plurality of metal standoffs 201 comprising small tabs. In this example the underside of the metal fret 200 also includes a registration component 202 that comprises a tab having a shorter length that the aforementioned metal standoffs 201. By one approach these various tabs are integral to the metal fret 200. (As used herein, this reference to "integral" will be understood to refer to a combination and joinder that is sufficiently complete so as to consider the combined elements to be as one. Accordingly, two items would not be considered "integral" with respect to one another if they are merely connected to one another by the action of a holding mechanism such as a screw, bolt, clamp, clip, an adhesive, or the like.)

The width of the metal fret 200 can vary with the application setting. For many purposes the width of the metal fret 200 will correspond to (or even equal) a desired spacing between, for example, rows of keycaps as comprise the keypad of interest. Similarly, the length of the metal fret 200 can vary depending upon, amongst other factors, the length of the keycap row or rows.

As already specified this fret 200 comprises one or more metals. By one approach the metal fret 200 comprises stainless steel. Other metals, however, can serve well depending upon the application setting. These teachings will also accommodate using essentially-pure elemental metals or alloys or even laminates of different metallic layers as desired.

Figure 3:
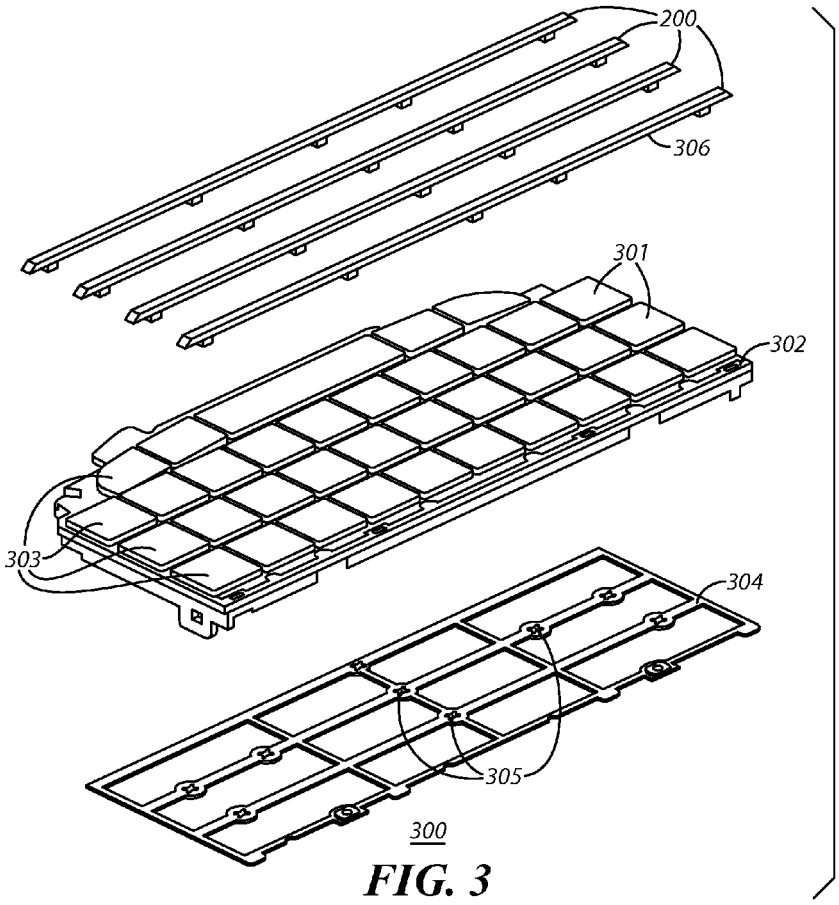
FIG. 3 is a perspective exploded view in accordance with the disclosure.

FIG. 3 depicts a keypad assembly 300 having four such metal frets 200. In this illustrative example three of these metal frets 200 are interposed amongst the keycaps 301 that comprise a part of a keypad frame. In particular, these three metal frets 200 are disposed between adjacent rows 303 of these keycaps 301. As these rows 303 are substantially parallel to one another, this plurality of metal frets 200 are also disposed substantially parallel to one another. Other shapes for the metal frets 200 can serve to accommodate, for example, other row shapes. For example, these teachings will readily accommodate using curved metal frets 200 in an appropriate application setting.

In this illustrative example a fourth one 306 of these metal frets 200 comprises an additional metal fret 200 that is disposed along a periphery of the keycaps 301 on the frontside of this keypad 300. In particular, this fourth 306 metal fret 200 is to be disposed along the front edge of the highest row of keycaps on the keypad 300.

Accordingly, in this illustrative example, the aforementioned disposing of one or more metal frets 200 amongst a plurality of keycaps 301 on the frontside of a keypad frame 302 comprises disposing at least some of the metal frets 200 amongst the plurality of keycaps 301 to thereby delineate corresponding rows 303 of keycaps 301. As will be illustrated below in more detail, this placement of the metal frets 200 can include, by one approach, registering the aforementioned registration component 202 on the metal frets 200 with a corresponding registration component-receiving opening (not shown in FIG. 3) formed in the keypad frame 302. The use of the registration component 202 in this way, in turn, can help to ensure proper placement of the metal frets 200 during the manufacturing process.

These teachings will accommodate a variety of approaches to the placement of these metal frets 200. Generally speaking, this process 100 will work well in conjunction with modern pick-and-place equipment that provides for automatically presenting and placing these metal frets 200 as described.

With continued reference to FIGS. 1 and 3, at 102 this process 100 also provides for disposing a metal spacer 304 on the backside of the keypad frame 302. In this illustrative example this metal spacer 304 comprises a grid-based spacer having a number of longitudinal members (equal, in this example, to the number of metal frets 200) as well as a plurality of cross members. By one approach these various members comprise integral parts of the metal spacer 304. In this illustrative example the metal spacer 304 also includes a plurality of registration component-receiving openings 305 disposed therethrough; the purpose and use of these openings 305 is described further below.

As noted, this spacer 304 comprises metal. By one approach this metal comprises stainless steel such that the metal spacer 304 comprises a stainless steel spacer. As with the metal frets 200 themselves, other metals can be suitable depending upon the particular application setting.

Figure 4:
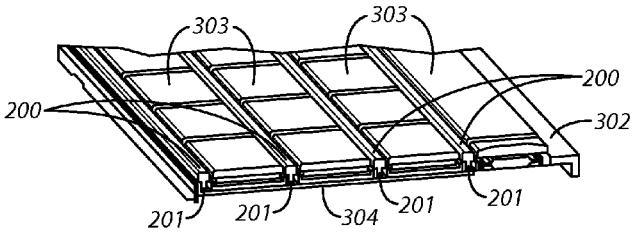
FIG. 4 is a perspective detail view in accordance with the disclosure.

FIG. 4 provides an illustrative example in these regards. In this example, the metal frets 200 are disposed with respect to the keycap rows 303 as described above. In addition, the metal spacer 304 is disposed (in this embodiment, flush) on the opposing side of the keypad frame 302. This figure provides a view in particular of some of the aforementioned metal standoffs 201 and illustrates that these metal standoffs 201 physically contact the metal spacer 304.

Figure 5:
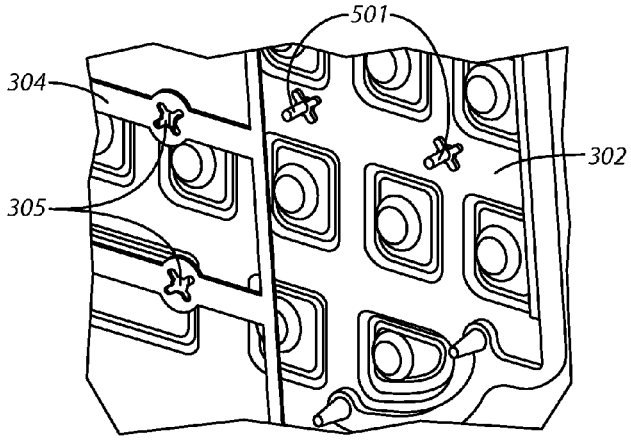
FIG. 5 is a bottom elevational detail view in accordance with the disclosure.

As described above the metal spacer 304 can include a plurality of registration component-receiving openings 305. By one approach, and referring now to FIG. 5, the keypad frame 302 can include, if desired, a corresponding plurality of registration components 501. In this example the registration components 501 are each substantially identical to one another and comprise posts that extend outwardly from the keypad frame 302 and that each have a "+"-shaped cross-sectional form factor.

When the registration component-receiving openings 305 of the metal spacer 304 have a similar corresponding shape in order to conformably receive the keypad frame's registration components 501, the metal spacer 304 is readily and accurately properly located with respect to the keypad frame 302 by placing the keypad frame 302 and the metal spacer 304 with respect to one another such that the registration components 501 each properly mates with a corresponding one of the registration component-receiving openings 305.

Figure 6:
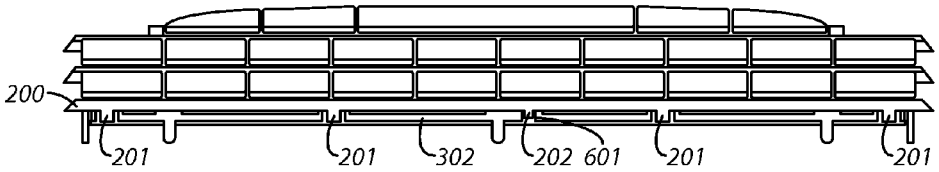
FIG. 6 is a front elevational schematic view in accordance with the disclosure.

FIG. 6 provides another view in these same regards and also depicts the aforementioned registration component 202 that can comprise a part of some or all of the metal frets 200. This metal fret registration component 202 does not extend all the way to the metal spacer 304 and is received instead in a corresponding registration component-receiving opening 601 in the keypad frame 302. Such an approach can serve to properly locate the metal frets 200 with respect to the keypad frame 302 (and also with respect to the metal spacer 304).

Figure 7:
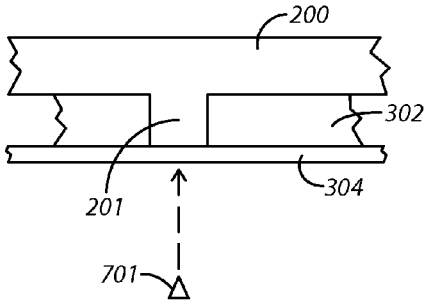
FIG. 7 is a front elevational detailed view in accordance with the disclosure.

Referring now to FIGS. 1, 6, and 7, the process, at 103, provides for connecting the metal frets 200 to the metal spacer 304. By one approach, this connection can be the result of using one or more lasers 701 for laser welding. In particular, laser heat applied to the exterior of the metal spacer 304 and just opposite a given one of the aforementioned metal standoffs 201 can readily and quickly weld the metal standoff 201 to the metal spacer 304. A number of lasers 701 can be utilized simultaneously to weld a plurality of metal standoffs 201 to the metal spacer 302 at substantially the same time, or a single laser 701 can be used in seriatim fashion to weld one metal standoff 201 after another to the metal spacer 304.

So configured, a plurality of metal frets 200 can be easily, quickly, and accurately placed as desired amongst the keycaps of a given keypad and secured in place via a connection to a metal spacer 304 on the opposing side of the corresponding keypad frame 302. This connection is readily accomplished in an automated manufacturing setting at low cost and provides a finished result that is both aesthetically pleasing and durable.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

We claim:

1. An apparatus comprising:

a keypad frame;

a metal spacer disposed on a backside of the keypad frame;

at least one metal fret disposed amongst keycaps on a frontside of the keypad frame, wherein the metal fret is directly affixed to the metal spacer.

2. The apparatus of claim 1 wherein the metal spacer comprises a grid-based spacer.

3. The apparatus of claim 1 wherein the metal spacer comprises a stainless steel spacer.

4. The apparatus of claim 1 wherein the keypad frame includes a plurality of registration components and wherein the metal spacer includes corresponding registration component-receiving openings disposed therein.

5. The apparatus of claim 1 wherein the metal fret affixes to the metal spacer via a plurality of metal standoffs.

6. The apparatus of claim 5 wherein a laser weld directly affixes the metal standoffs to the metal spacer.

7. The apparatus of claim 5 wherein the metal fret further comprises at least one registration component that is configured to conformably register with a registration component-receiving opening in the keypad frame.

8. The apparatus of claim 1 wherein the at least one metal fret comprises a plurality of metal frets that are disposed amongst the keycaps on the frontside of the keypad frame, wherein the plurality of metal frets are all directly affixed to the metal spacer.

9. The apparatus of claim 8 wherein the plurality of metal frets are disposed substantially parallel to one another.

10. The apparatus of claim 8 further comprising at least one additional metal fret that is disposed along a periphery of the keycaps on the frontside of the keypad frame, wherein the at least one additional metal fret is directly affixed to the metal spacer.

11. A method comprising:

disposing at least one metal fret amongst a plurality of keycaps on a frontside of a keypad frame;

disposing a metal spacer on a backside of the keypad frame;

directly affixing the at least one metal fret to the metal spacer.

12. The method of claim 11 wherein directly affixing the at least one metal fret to the metal spacer comprises laser welding the at least one metal fret to the metal spacer.

13. The method of claim 11 wherein disposing at least one metal fret amongst the plurality of keycaps comprises disposing a plurality of the metal frets amongst the plurality of keycaps to thereby delineate corresponding rows of keycaps.

14. The method of claim 11 wherein disposing at least one metal fret amongst a plurality of keycaps on a frontside of a keypad frame comprises registering at least one registration component on the metal fret with a corresponding registration component-receiving opening formed in the keypad frame.

15. The method of claim 11 wherein disposing the metal spacer on the backside of the keypad frame comprises registering a plurality of registration components on the keypad frame with corresponding registration component-receiving openings formed in the metal spacer.

* * * * *